US006945821B2

(12) United States Patent
Stoner et al.

(10) Patent No.: US 6,945,821 B2
(45) Date of Patent: Sep. 20, 2005

(54) CONNECTOR

(75) Inventors: Mark Peter Stoner, Dassel, MN (US); John Joseph Heinsch, Watertown, MN (US); David Leland Osterkamp, Dassel, MN (US)

(73) Assignee: Crest Health Care, Sauk Rapids, MN (US)

( * ) Notice: Subject to any disclaimer, the term of this patent is extended or adjusted under 35 U.S.C. 154(b) by 0 days.

(21) Appl. No.: 10/413,891

(22) Filed: Apr. 14, 2003

(65) Prior Publication Data

US 2003/0194910 A1 Oct. 16, 2003

Related U.S. Application Data

(60) Provisional application No. 60/372,898, filed on Apr. 15, 2002.

(51) Int. Cl.[7] ..... H01R 33/90
(52) U.S. Cl. ..... 439/638; 439/639
(58) Field of Search ..... 439/638, 639, 439/650, 654, 502, 506; 340/825.19

(56) References Cited

U.S. PATENT DOCUMENTS

| | | | | | |
|---|---|---|---|---|---|
| 4,156,265 | A | * | 5/1979 | Rose | 439/188 |
| 4,489,419 | A | | 12/1984 | Wang | 375/36 |
| 4,671,585 | A | | 6/1987 | Langer et al. | 439/117 |
| 4,767,350 | A | | 8/1988 | Cooper et al. | 439/271 |
| D305,224 | S | * | 12/1989 | Iwashita | D13/147 |
| 4,941,845 | A | * | 7/1990 | Eppley et al. | 439/505 |
| 5,013,260 | A | | 5/1991 | Caveney et al. | 439/535 |
| 5,038,000 | A | | 8/1991 | Westbrook et al. | 174/52.1 |
| 5,192,226 | A | * | 3/1993 | Wang | 439/502 |
| 5,205,758 | A | | 4/1993 | Comerci et al. | 439/535 |
| 5,411,416 | A | * | 5/1995 | Balon et al. | 439/639 |
| 5,430,618 | A | * | 7/1995 | Huang | 361/818 |
| 5,562,493 | A | | 10/1996 | Ferrill et al. | 439/536 |
| 5,590,228 | A | | 12/1996 | Gibola et al. | 385/56 |
| 5,596,169 | A | * | 1/1997 | Baker et al. | 174/33 |
| 5,695,361 | A | | 12/1997 | Elisei | 439/535 |
| 6,146,153 | A | * | 11/2000 | Koradia et al. | 439/76.1 |
| 6,302,742 | B1 | * | 10/2001 | Berst et al. | 439/638 |
| 6,439,916 | B1 | * | 8/2002 | Kuo | 439/362 |
| 6,459,590 | B2 | * | 10/2002 | Malnati | 361/752 |
| 6,482,042 | B1 | * | 11/2002 | Tupper | 439/638 |
| 6,580,848 | B2 | * | 6/2003 | Hartl | 439/577 |

FOREIGN PATENT DOCUMENTS

| | | | |
|---|---|---|---|
| EP | 0 614 249 A2 | 9/1994 | H01R/23/02 |
| EP | 0 274 487 B1 | 1/1995 | H01R/31/00 |
| EP | 0 614 248 B1 | 11/1996 | H01R/23/02 |
| WO | WO 99/15125 | 4/1999 | A61G/7/00 |

* cited by examiner

*Primary Examiner*—Briggitte R. Hammond
(74) *Attorney, Agent, or Firm*—Dorsey & Whitney LLP

(57) ABSTRACT

The present invention relates to an adapter, wherein the adapter has a housing with a rear face, a front face, an outside perimeter face. A first connector is located on the rear face. A second connector and a third connector are located on the front face. A mounting piece is located on the outside perimeter face. The first connector is designed to mate with a connector located on an interface unit coupled to a medical facility communication system. The second connector is designed to mate with a connector on a first end of a communications cable. The second end of the communications cable is connected to an interface, such as a hospital bed interface. The mounting piece has mounting holes that allow the adapter to be attached to the interface unit.

13 Claims, 12 Drawing Sheets

B-B

CONNECTOR

RELATED APPLICATIONS

This application claims priority to U.S. Provisional App. Ser. No. 60/372,898, filed on Apr. 15, 2002, entitled "Connector."

BACKGROUND

The present invention, in one embodiment, relates to methods and apparatus for connecting cables, such as communication cables, to interface units. More specifically, the present invention, in one embodiment, relates to methods and apparatus for connecting a hospital bed communications cable connector to an interface unit connector.

It is common for hospital bed manufacturers to integrate into the side rail of their beds an interface for nurse call, bed, lighting, and entertainment control, as well as a speaker for television and nurse call intercom audio. A communications cable provides the connection for these control signals from the TV or nurse call system to the bed via an interface unit located on a wall or at a station. Hospital beds are often moved and sometimes this is done in haste without disconnecting the communications cable from the wall or the bed interface.

FIG. 1*a* shows a prior art communications cable 2 as described below. Current hospital bed interface units are typically designed to be attached to the communications cable 2 via a D-subminiature connector 4 with thumbscrews 6, whereas the wall interfaces are typically designed to be connected to the other cable end 8 via a friction fit 37-pin D-subminiature male connector 9, as shown in FIG. 1*b*, mating with a female connector. The 37-pin D-subminiature male connector 9, which is typically located on the end of the cable 2, is subject to frequent damage. Some of the ways in which the connector 9 can be damaged are from: moving the bed without first disconnecting the connector 9, which results in the bending of one or more of the pins; trying to connect or reconnect the connector 9 incorrectly and bending individual pins; rolling the bed casters over the connector 9 when it is disconnected from the interface unit; or disconnecting the cable 2 by pulling with great force at sharp angles on the cable 2. Such damage to the 37-pin D-subminiature connector 9 greatly reduces the useful life of communication cables 2.

Various efforts have been made to minimize connector damage. One involves a retrofit kit that prevents inadvertent mismatching of the 37-pin connectors. Another effort involves providing a communication cable with a more robust male and female connector in the middle of the cable, wherein the cable is designed to disconnect in the middle rather than at the wall. Other efforts have been made to strengthen the design of the 37-pin connector. Each of these has proven to be inadequate in providing an optimally durable, yet easily used, convenient communication cable connection.

BRIEF SUMMARY

In one embodiment, the present invention is an adapter for connecting two connectors. The adapter has a housing having a front face, a rear face and an outside perimeter face. A first connector is located on the rear face. A second connector and a third connector are located on the front face. The three connectors are different and the adapter facilitates the connection of a communications cable to a wall interface unit.

The present invention, in another embodiment, is a communications system for communicating between a bed interface module of a hospital bed and a medical facility communication system, wherein the bed interface module has a first connector. The system comprises a wall interface module, a communication cable, and an adapter. The wall interface module is operably coupled to the medical facility communication system and includes a second connector. The communication cable comprises a first end and a second end. The first end includes a third connector and the second end includes a fourth connector that is compatible with the first connector. The adapter is configured to be interposed between the wall interface module and the first end of the communication cable. The adapter comprises a fifth connector that is compatible with the second connector and a sixth connector that is compatible with the third connector.

In another embodiment, the present invention is a method for connecting a communications cable to a wall interface unit in a hospital bed environment, wherein a cable has a first connector and the interface unit has a second connector, and wherein the first and second connectors are incompatible. The method comprises providing an adapter between the incompatible connectors, wherein the adapter comprises a housing having a front side and a backside, a third connector located on the front side and configured to be compatible with the first connector, and a fourth connector located on the back side and configured to be compatible with the second connector. The method also comprises connecting the first connector to the third connector and connecting the second connector to the fourth connector.

In another embodiment, the present invention is a communications cable for connecting between a bed interface module of a hospital bed and an adapter configured to connect to a wall interface module connected to a medical facility communication system. The bed interface module has a first connector and the adapter includes a magnetically actuated reed switch and a second connector. The communication cable comprises a first end including a third connector that is compatible with the first connector. The communication cable also comprises a second end including a magnet and a fourth connector that is compatible with the first connector. The magnet actuates the reed switch when the fourth connector is connected to the second connector.

In another embodiment, the present invention is a retrofittable, low profile connector or adapter that easily and permanently mounts to a variety of interface configurations including wall panels or receptacles and bed interface stations or units. This is accomplished by providing a housing having a mounting structure, such as ears or flanges, with holes spaced for standard and custom mounting to existing wall receptacles, including those with yokes, to bed interface units, or to electrical boxes.

The connector or adapter of the present invention converts the connection at the wall to robust male and female connectors, such as the 36-pin Centronics type. This type of connector does not use male pins that are easily damaged when connected and disconnected repeatedly. For backward compatibility, a 37-pin female can also be provided on the adapter.

In this embodiment, the communication cable has the standard 37-pin connection at the bed and a low profile mating connector at the adapter. The low profile of the adapter and cable plug provides adequate clearance from the bed frame and mechanisms and minimizes interference with equipment or devices commonly used near or in the bed. The design of the 36-pin plug on the communication cable is such that it can withstand having a hospital bed rolled over it. In other embodiments of the present invention, the communications cable will have a right angle cord exit Centronics connector and an adapter with a 36-pin Centronics connector.

The present invention, in the embodiment of connecting a hospital bed to a head wall, offers at least the following features and concepts: a low-profile adapter designed to be attached to a variety of wall interface station configurations; an alternate connection to a 37-pin communications cable interface; a rugged plug design for a communications cable; and a controlled attachment and release mechanism for a pin connection.

While certain embodiments of the present invention are disclosed, other embodiments will become apparent to those skilled in the art from the following detailed description. As will be apparent, the invention is capable of modifications in various aspects, without departing from the spirit and scope of the present invention. Accordingly, the drawings and detailed description are to be regarded as illustrative, not restrictive.

DETAILED DESCRIPTION

Figure 1B:
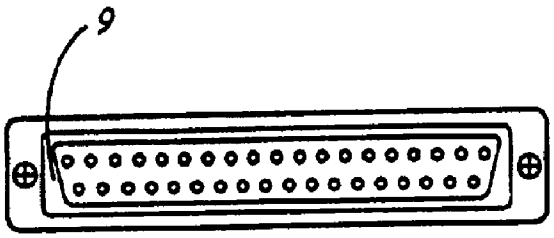
FIG. 1b (Prior Art)
FIG. 1*b* is an end elevation view of the connection portion of the 37 pin plug that connects to a wall as shown in FIG. 1*a*
Figure 1A:
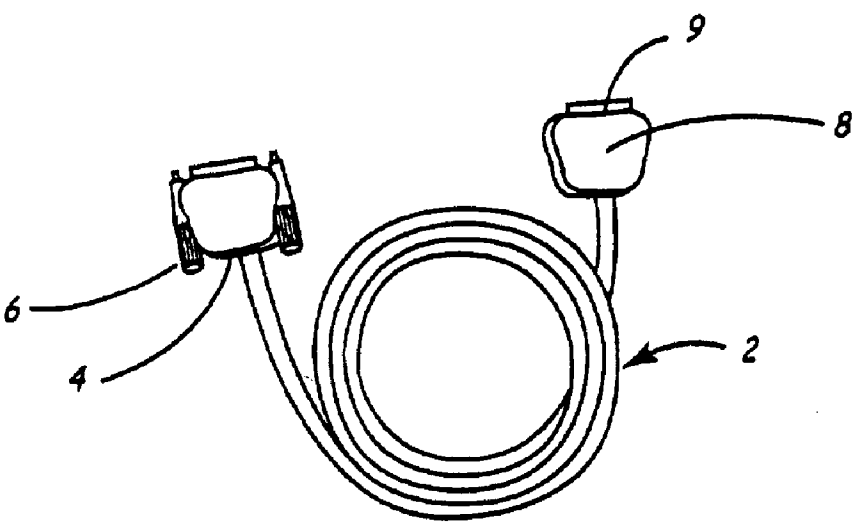
FIG. 1a (Prior Art)
FIG. 1*a* is a prior art communications cable utilizing a 37-pin D-subminiature connector on both ends.
Figure 3:
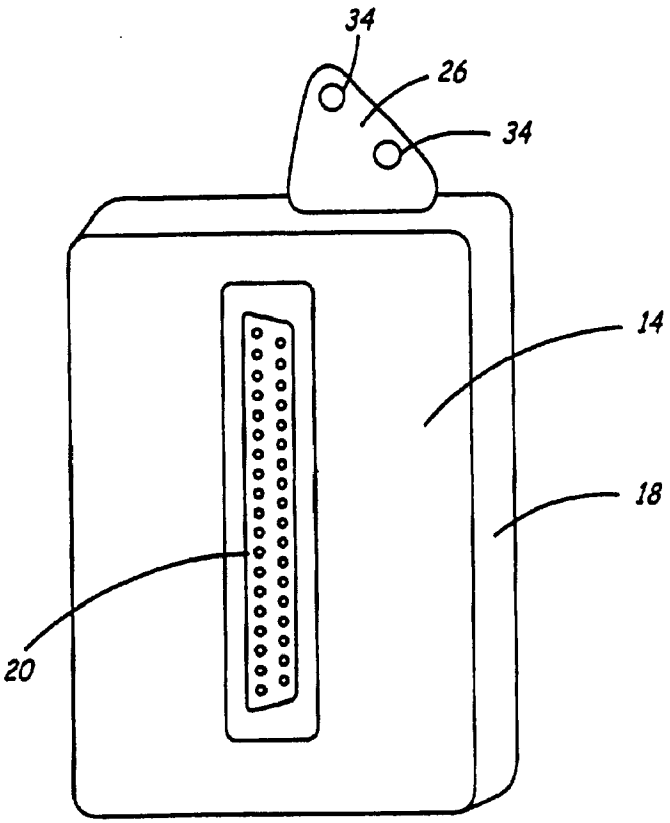
FIG. 3 is a rear isometric view of an adapter of the present invention.
Figure 2:
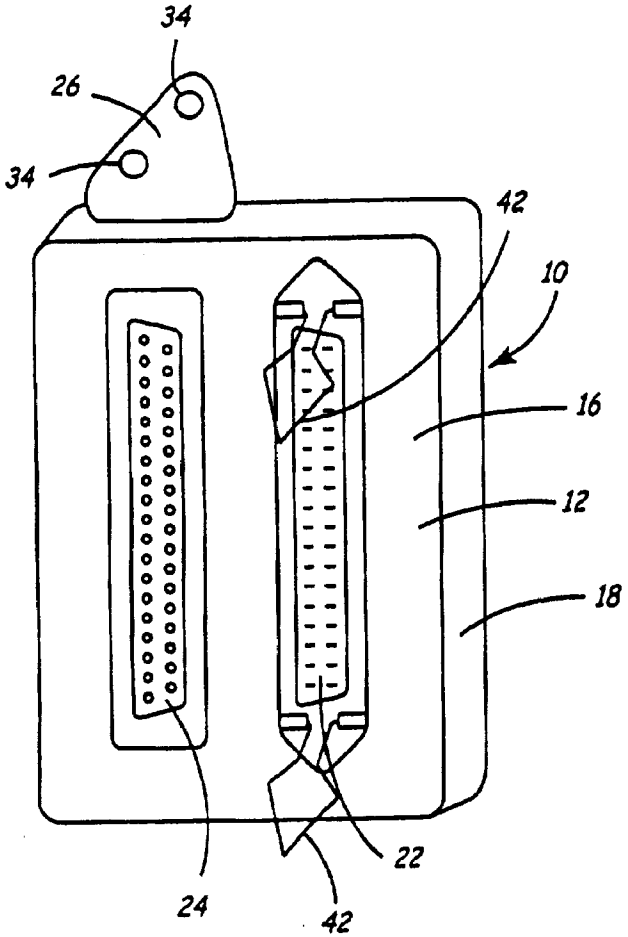
FIG. 2 is a front isometric view of an adapter of the present invention.

FIGS. 2 and 3 show a front and rear side, respectively, of one embodiment of the adapter 10 of the present invention. In this embodiment, the adapter 10 comprises a housing 12 having a rear face 14, a front face 16 and an outer perimeter face 18. The rear face 14 contains a wall interface connector 20 and the front face 16 contains a primary cable connector 22 and a secondary cable connector 24.

As shown in FIGS. 2 and 3, a mounting piece 26 is located on the outer perimeter face 18 of the adapter 10. In some embodiments, there will be both upper and lower mounting pieces 26. In other embodiments, there will only be upper or lower mounting pieces 26. In yet other embodiments, the mounting pieces 26 will be located at other locations along the outer perimeter face 18 of the adapter 10. In some embodiments, the mounting pieces 26 may be designed with multiple mounting holes 34 so the adapter 10 can be compatible with a variety of interface units having differently spaced mounting areas. A controlled attachment and release mechanism, such as attachment clamps 42, can also be utilized in order to assist in securing attachment of a cable to the connectors on the front face 16.

In one embodiment, the wall interface connector 20 is a 37-pin D-subminiature male plug, which is designed to be compatible with a connector in a wall unit, the primary cable connector 22 is a 36 pin Centronics female connector, and the secondary cable connector 24 is the same design as the connector located on the wall interface unit. Because the secondary cable connector 24 is the same design as the connector located on the wall interface unit, cables utilizing connectors that are designed to mate with the original connector on the interface unit may be connected without removing the adapter 10. This feature allows the adapter 10 to be permanently attached to the interface unit 28. In other embodiments, there is no secondary cable connector 24. In yet other embodiments, the secondary cable connector 24 is designed to be compatible with connectors other than those that are compatible with any of the other connectors. In other embodiments, the primary cable connector 22 is any Centronics connector.

In other embodiments, the adapter 10 is designed to be interposed between, and facilitate connection between, a connector of a communications cable and a connector of a wall interface in a hospital bed environment where the cable and wall connectors are incompatible. In another embodiment, the present invention is a method for connecting a communications cable to a wall interface unit in a hospital bed environment where a connector on the cable and a connector on the wall are incompatible.

Figure 4:
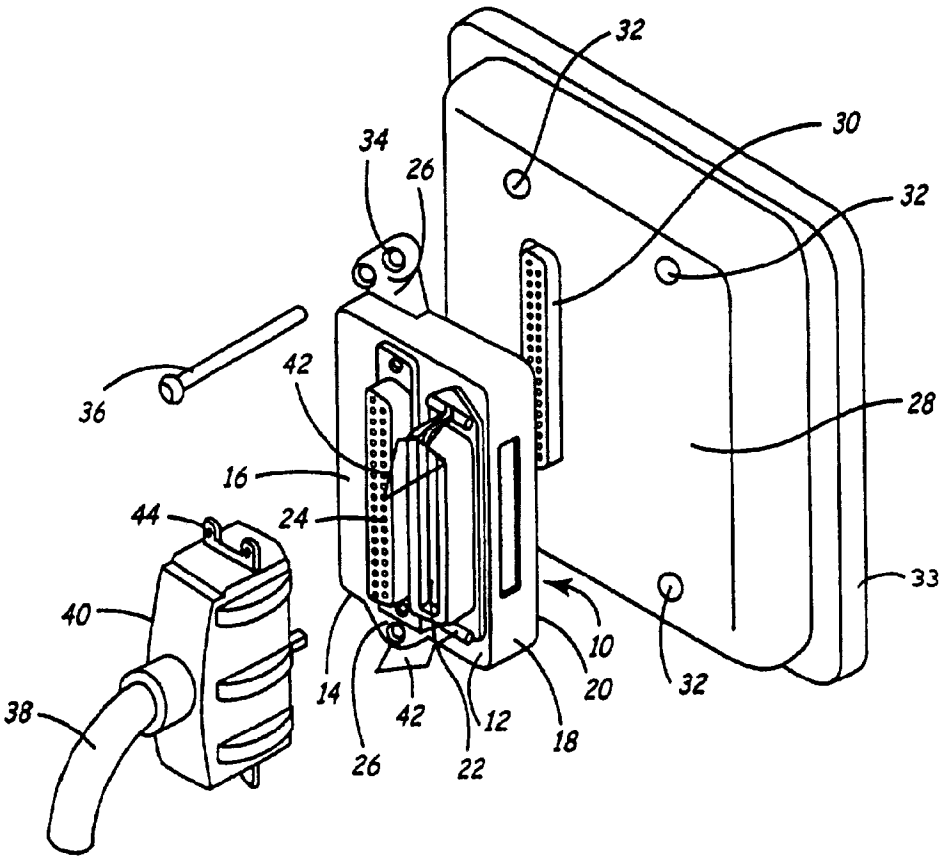
FIG. 4 is an exploded isometric view of the communications cable-wall interface connection system of one embodiment of the present invention.

FIG. 4 is an exploded isometric view of one embodiment of the present invention. The interface unit 28 of the present invention may comprise any interface unit designed for connection with a cable, including those designed for connection to a communication cable. Typically, such interface units 28 usually comprise an interface cable connector 30 and mounting holes 32. The wall interface connector 20 located on the rear 14 of the adapter 10 is designed to be compatible with the interface cable connector 30 located on the front of the interface 28. In one embodiment, the wall interface connector 20 is a 37-pin D-subminiature male plug and the interface cable connector 30 is a 37-pin D-subminiature female plug. Other types of connectors are possible.

As shown in FIG. 4, the mounting holes 32 are designed for mounting the interface unit 28 to an interface wall station, panel or plate 33 located in or on the medical facility wall. In one embodiment, the mounting pieces 26 on the adapter 10 are designed with mounting holes 34 that will align with the mounting holes 32 on the interface unit 28 so the adapter 10 can be permanently or semi-permanently connected to the interface unit 28 with a screw 36 or other suitable fastening device. In some embodiments, the mounting pieces 26 may be designed with multiple mounting holes 34 so the adapter 10 can be compatible with a variety of interface units 28 having differently spaced mounting holes 32.

As illustrated in FIG. 4, in one embodiment, the communications cable 38 has a cable end connector 40 on its end. The cable end connector 40 is designed to be compatible with the primary cable connector 22 located on the front face 16 of the adapter 10. In one embodiment, the primary cable connector 22 is a 36-pin Centronics female connector and the cable end connector 40 is a 36-pin Centronics male connector. In other embodiments, as long as the primary cable connector 22 and cable end connector 40 are compatible, the connector sexes may be reversed or the connectors may be a type of connector other than a Centronics 36-pin connector.

In one embodiment, the secondary cable connector 24, which is located on the front face 16 of the adapter 10, is the same design as the interface cable connector 30, which is located on the interface unit 28. This allows for the optional connection of communication cables 38 utilizing connectors that are designed to mate with the original interface cable connector 30 on the interface unit 28 without needing to remove the adapter 10. Thus, the adapter 10 may be permanently attached to the interface unit 28. In other embodiments, there is no secondary cable connector 24. In yet other embodiments, the secondary cable connector 24 is designed to be compatible with connectors other than those that are compatible with any of the other connectors.

Figure 5:
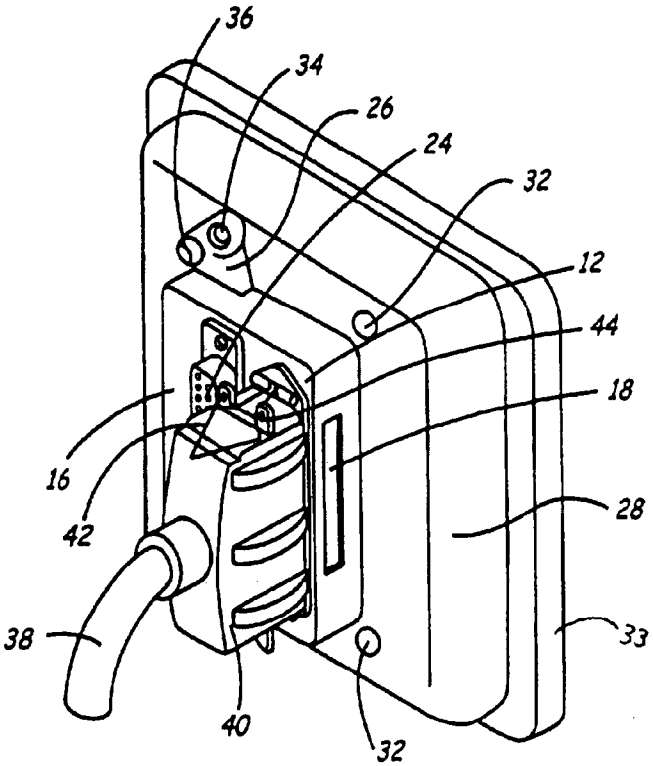
FIG. 5 is an isometric view of the assembled communications cable-wall interface connection system in the embodiment shown in FIG. 4.

FIG. 5 shows the components of FIG. 4 in an assembled state according to one embodiment of the invention. The adapter 10 is operably connected to the interface unit 28 with the wall interface connector 20 and the interface cable connector 30 in mating connection. The fasteners 36 connect the adapter 10 to the interface unit 28 through the mounting holes 34 on the mounting pieces 26 and the mounting holes 32 on the interface unit 28. The communications cable 38 is connected to the adapter 10 with the primary cable connector 22 and the cable end connector 40 in mating connection.

As shown in FIGS. 4 and 5, to secure the connection between the primary cable connector 22 and cable end connector 40, a controlled attachment and release mechanism is provided. In one embodiment, the controlled attachment and release mechanism comprises attachment clamps 42 and brackets 44. In one embodiment, the attachment clamps 42 are located on the front face 16 and the brackets 44 are located on the cable end connector 40. In other embodiments, their locations are reversed. These devices are designed to mate in way that secures the connection between the primary cable connector 22 and cable end connector 40 while allowing a disconnect to occur at a specified force.

Figure 6:
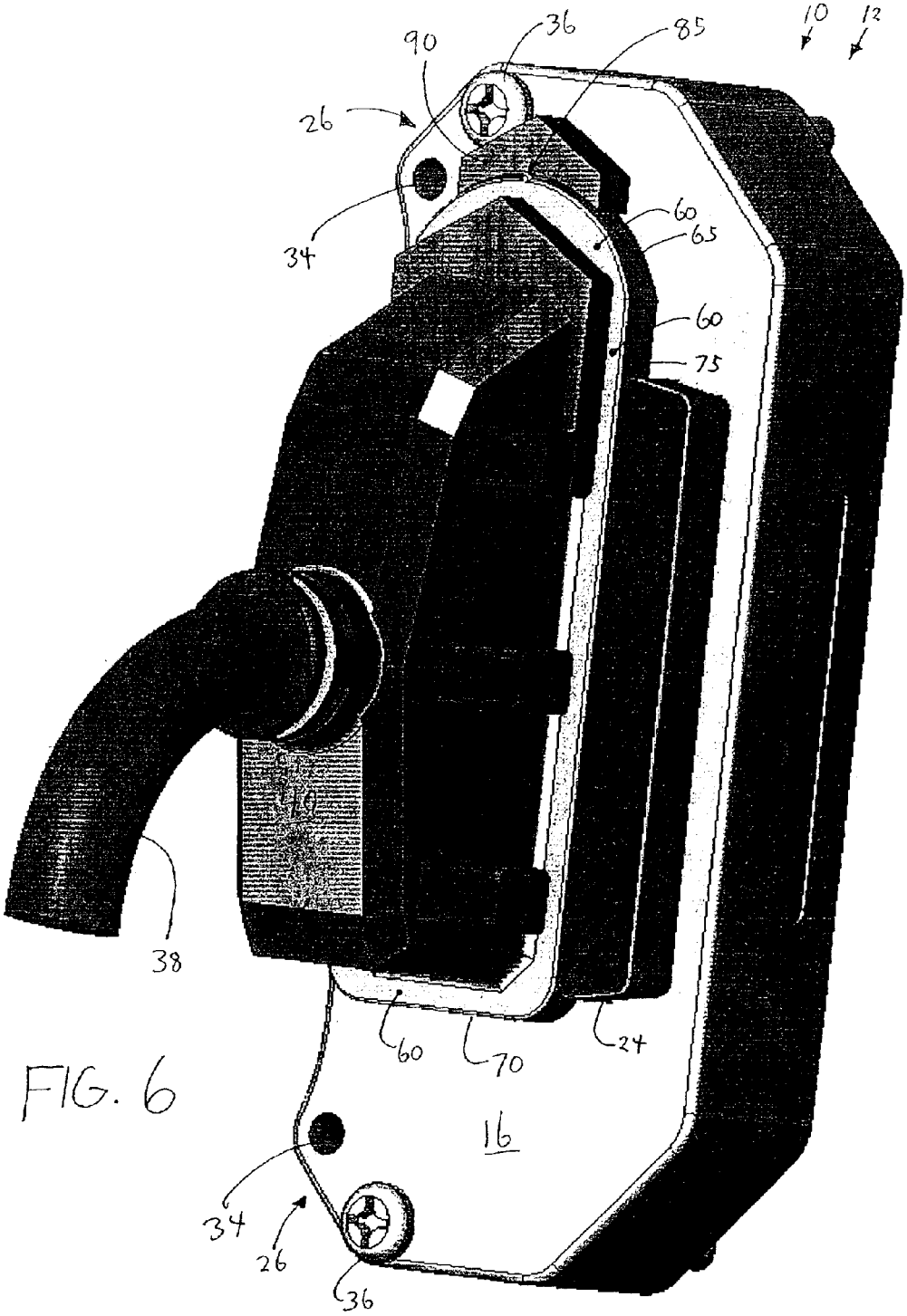
FIG. 6 is a perspective view of the communications cable connector secured to the adapter in an alternative embodiment of the invention.

In one embodiment, as illustrated in FIG. 6, the controlled attachment and release mechanism does not utilize attachment clamps 42 and brackets 44 to secure connection between the cable end connector 40 and primary cable connector 22. Instead, the connection between the primary cable connector 22 and cable end connector 40 is secured via a friction fit arrangement between the cable end connector 40 and the adapter 10. The friction fit secures the connection between the primary cable connector 22 and cable end connector 40 while allowing a disconnect to occur at a specified force.

Figure 7:
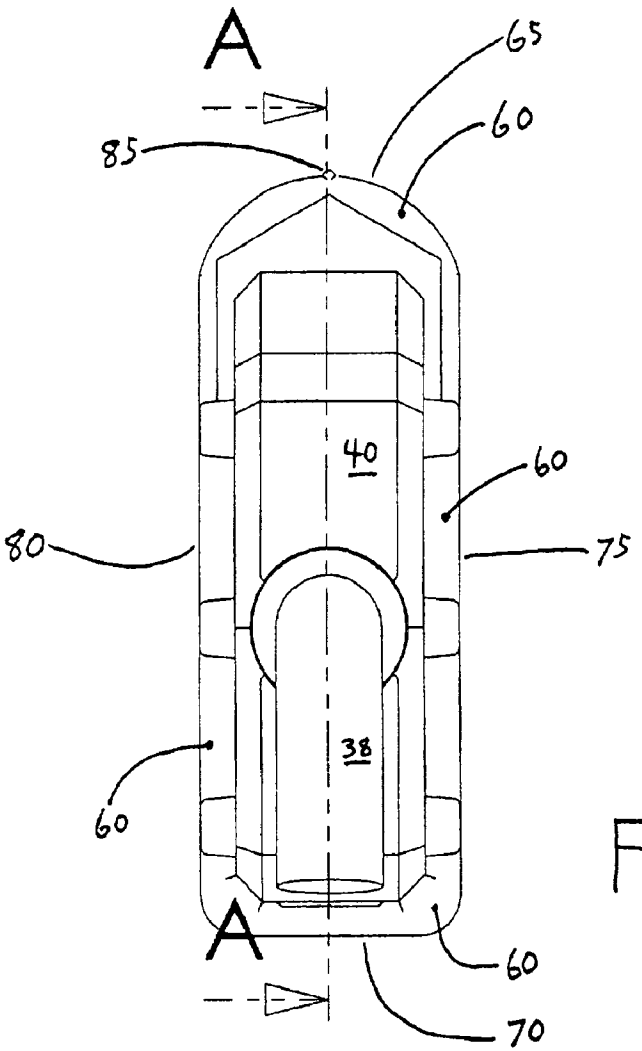
FIG. 7 is a front elevation view of the communications cable connector of FIG. 6.

As shown in FIGS. 6 and 7, the cable end connector 40 has an outer rim 60 that forms a perimeter about the cable end connector 40. The outer rim 60 has a toe 65, a heal 70, a first side 75, and a second side 80. The toe 65 is arcuately shaped and has a bump 85 that protrudes from the surface of the toe 65. In another embodiment, the heel 70 will have the bump 85. In another embodiment, one or both sides will have bumps 85. In yet other embodiments, other bump location combinations will be utilized. In other embodiments, the toe 65 will have other shapes.

Figure 8:
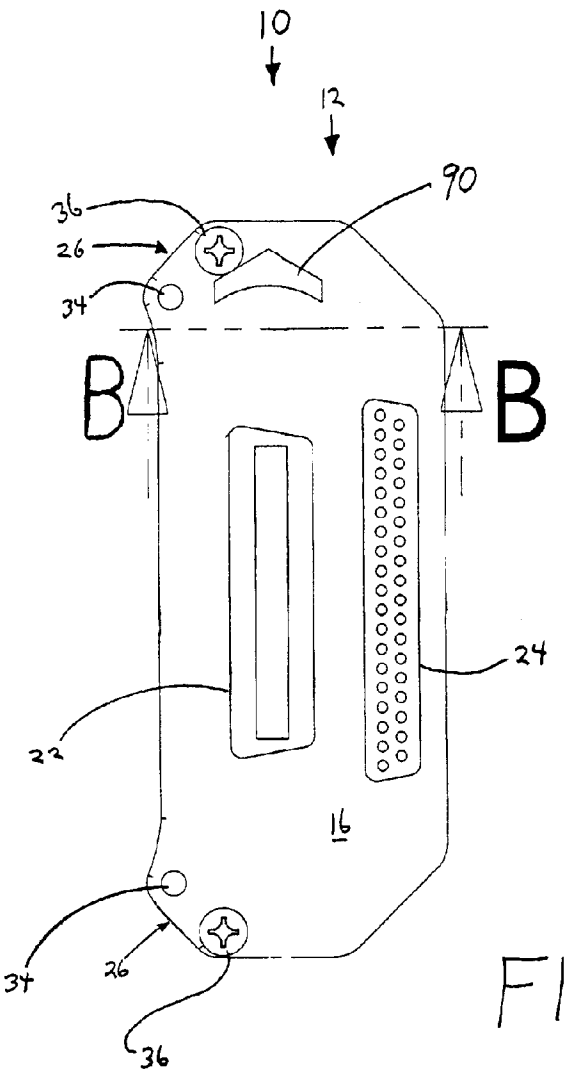
FIG. 8 is a front elevation view of the adapter of FIG. 6.

As indicated in FIGS. 6 and 8, a toe stop 90 and a secondary cable connector 24 are located on the front face 16 of the adapter 10. The toe stop 90 is arcuately shaped for receiving the toe 65. In other embodiments, the toe stop 90 will be other shapes and these shapes will correspond to the shape of the toe 65 to be received by the toe stop 90. As shown in FIG. 6, the toe 65 tightly abuts against the toe stop 90, resulting in a friction fit between the primary cable connector 22 and the cable end connector 40. In other embodiments, the friction fit will result from the first side 75 of the outer rim 60 abutting against the side of the secondary cable connector 24. In other embodiments, the friction fit will result from the heel 70 abutting against a heel stop. In yet other embodiments, the friction fit will result from various combinations of these means. In other embodiments, the friction fit results from structural interaction between the primary cable connector 22 and the cable end connector 40.

Figures 9A, 9B, 9C:
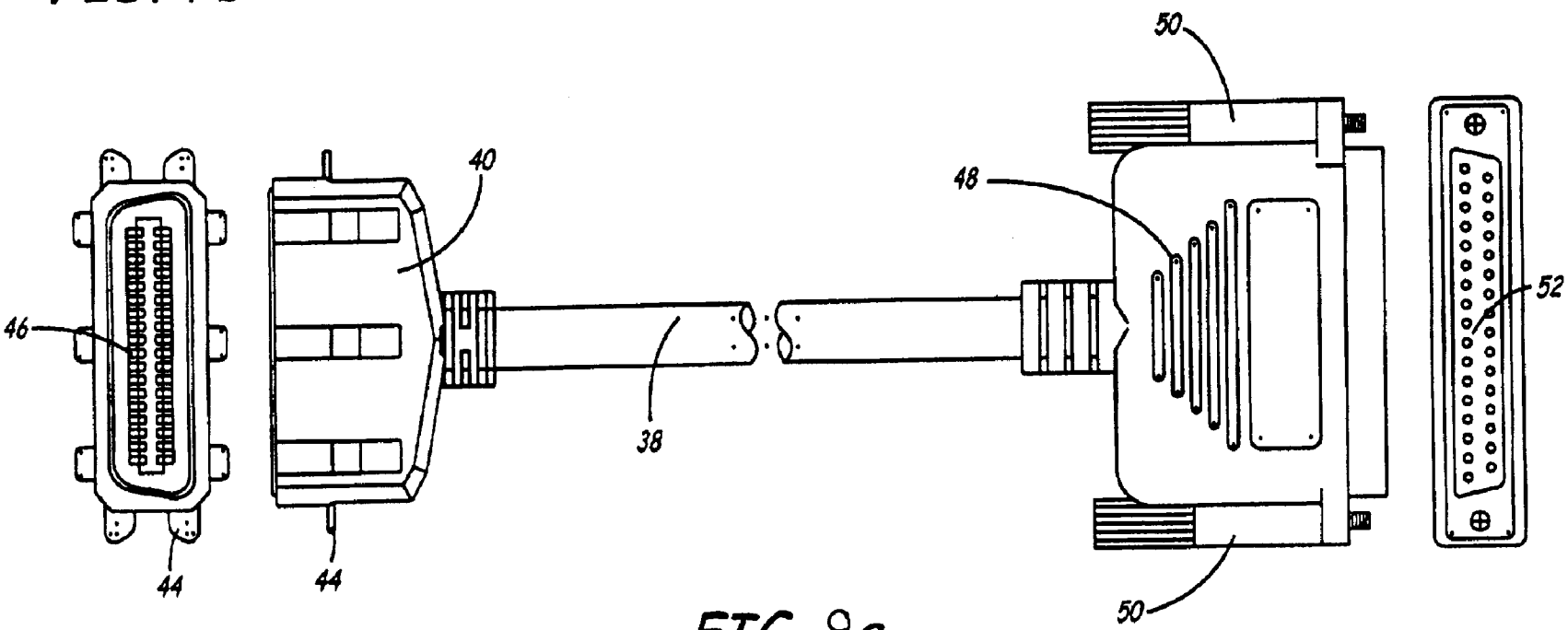
FIG. 9*a* is a top view of one embodiment of a communications cable of the present invention.
FIG. 9*b* is an end elevation view of the connection portion of the 36-pin plug shown in FIG. 9*a*.
FIG. 9*c* is an end elevation view of the connection portion of the 37-pin plug shown in FIG. 9*a*.

FIG. 9*a* shows an exemplary communications cable 38 used in one embodiment of the present invention. The cable 38 has a cable end connector 40 and a bed interface connector 48. The cable end connector 40 of the cable 38 connects to the primary cable connector 22 on the front face 16 of the adapter 10. The bed interface connector 48 connects with an interface, for example a hospital bed interface.

The cable end connector 40, as described above, is a rugged connector suitable for the application and, in one embodiment, is a 36-pin Centronics male connector. FIG. 9*b*, which is an end elevation of the cable end connector 40, illustrates the pins 46 of the cable end connector 40. Connectors of the 36-pin Centronics type are advantageous over 37-pin D-subminiature connectors in this environment. This is because the Centronics connectors have a more durable design and can withstand more physical abuse than the D-subminiature connectors.

In one embodiment, the bed interface connector 48 of the communications cable 38 is designed to be compatible with a hospital bed interface unit. Hospital bed interface units are typically designed to be attached to the communications cable via a D-subminiature 37-pin female connector with thumbscrews 50. FIG. 9*c*, which is an end elevation of the bed interface connector 48, shows the pins 52 of the bed interface connector 48. In other embodiments, the two ends of the cable 38 can have different types of connectors, as long as they are compatible with their intended connection points.

Typically, the connectors at the connection between the cable 38 and the hospital bed interface unit are not damaged as often as the connectors at the connection between the cable 38 and the wall interface. This is because the connectors at the connection between the cable 38 and the wall interface are more often detached and reattached. For example, the connectors at the connection between the cable 38 and the hospital bed interface unit often remain connected and are not detached when the bed is moved. This is because the communications cable 38 often travels with the bed as the bed is moved to another location within the medical facility.

Figure 10:
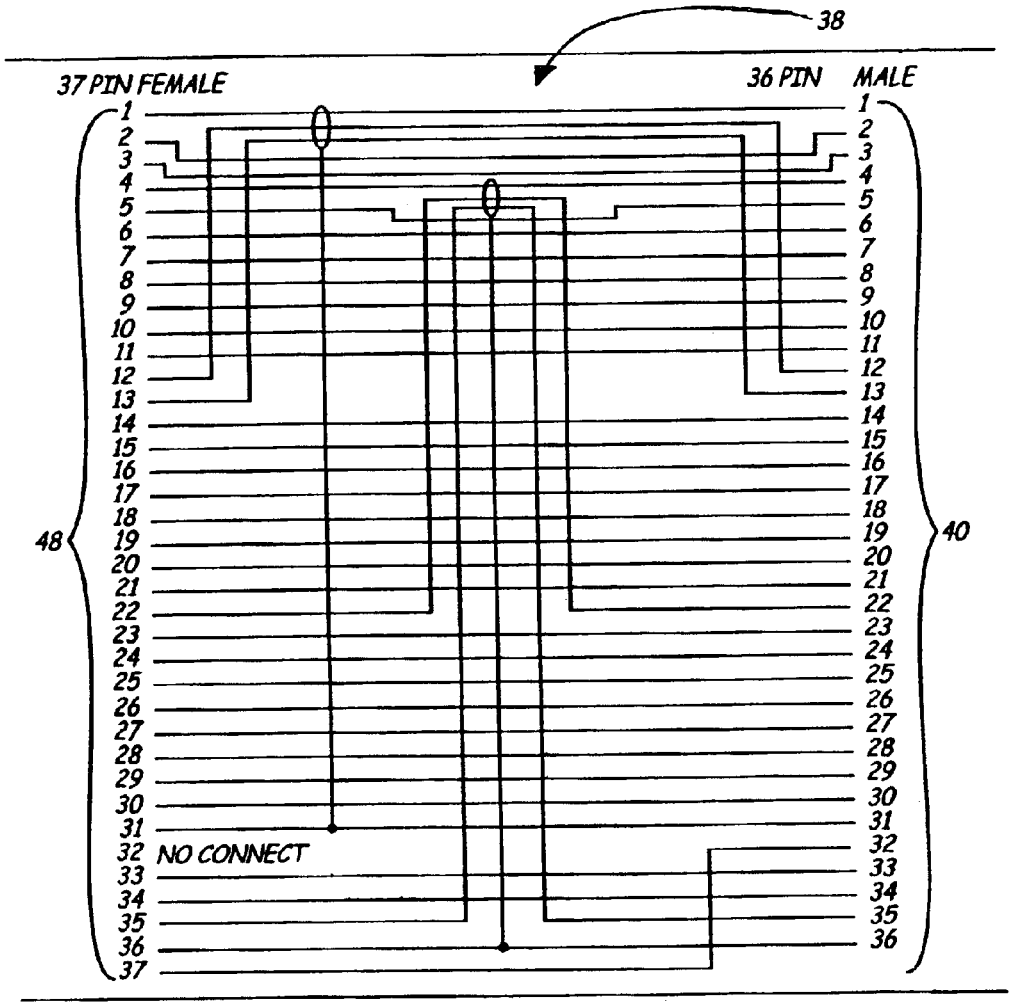
FIG. 10 is a wiring diagram of the communications cable in one embodiment of the present invention.

FIG. 10 shows a wiring diagram of an exemplary communications cable 38 of one embodiment of the present invention. In the embodiment shown in FIG. 10, the cable 38 is that shown in FIG. 9*a*. The cable end connector 40 of the cable 38 has a 36-pin connector, and the bed interface connector 48 of the cable 38 has a 37-pin connection member. FIG. 10 illustrates how the two different connectors 40, 48 may be wired so that information can flow through the cable 38 without compatibility issues.

Figure 11:
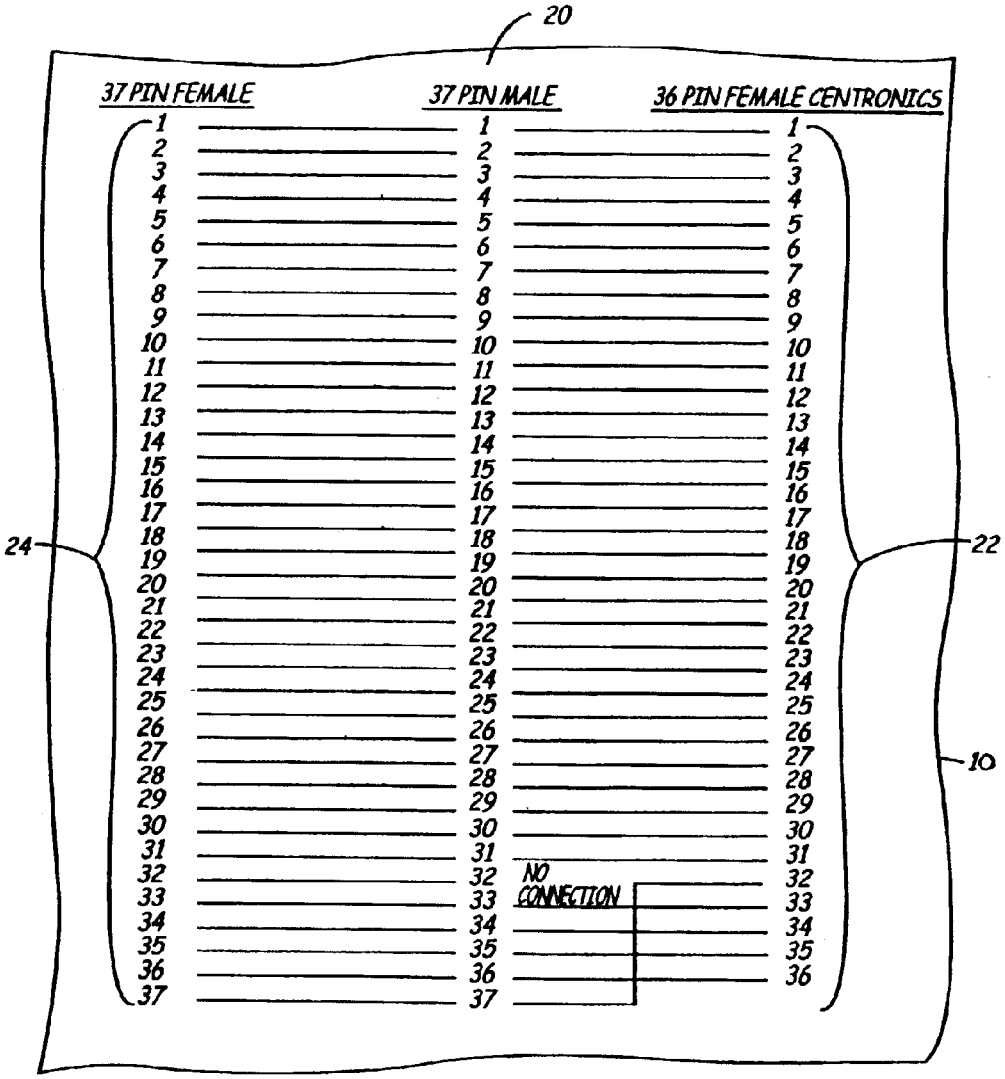
FIG. 11 is a wiring diagram of the adapter in one embodiment of the present invention.

FIG. 11 shows a wiring diagram of the inside of the adapter 10 of one embodiment of the present invention. In the embodiment of FIG. 11, the wall interface connector 20, as described above in FIG. 4, is a 37-pin D-subminiature male connector, the primary cable connector 22 is a 36-pin Centronics female connector, and the secondary cable connector 24 is a 37-pin D-subminiature female connector. FIG. 11 illustrates how, in this embodiment, the primary cable connector 22 and the secondary cable connector 24 are wired to the wall interface connector 20 so information may travel through the device without interruption.

Figure 12:
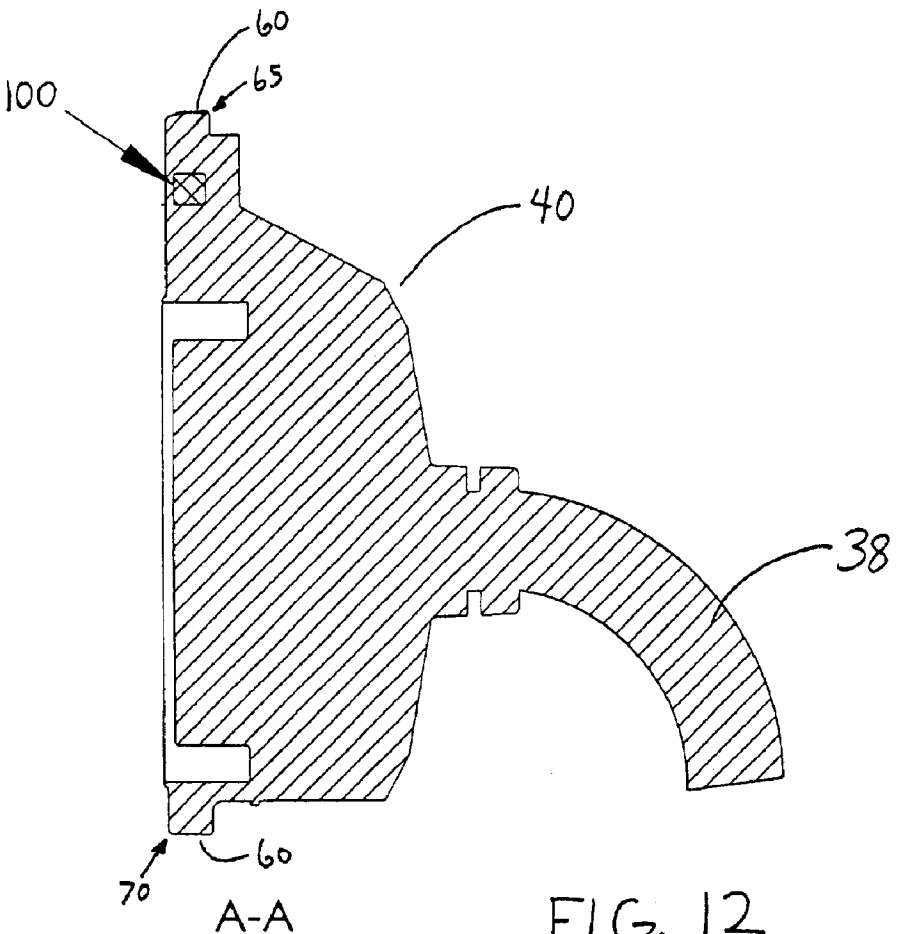
FIG. 12 is a cross-section elevation of the communications cable connector along section line AA of FIG. 7.
Figure 13:
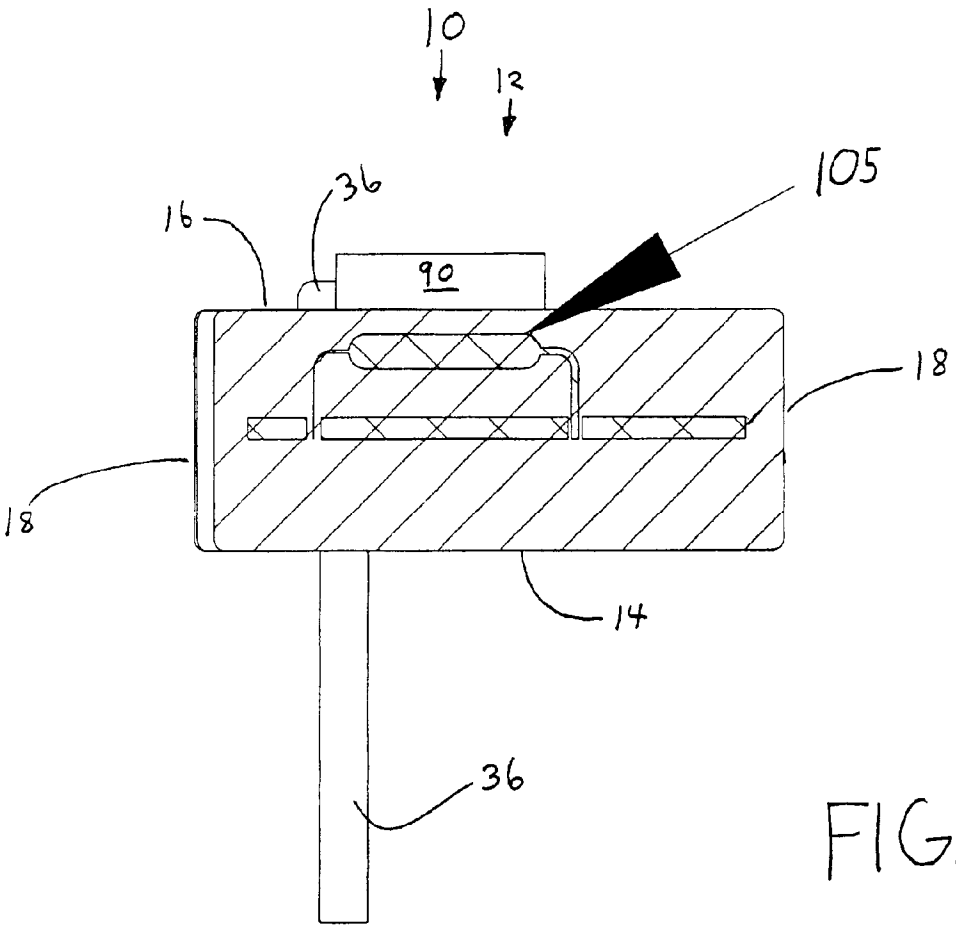
FIG. 13 is a cross-section elevation of the adapter along section line BB of FIG. 8.

In one embodiment of the invention, as shown in FIGS. 12 and 13, the cable end connector 40 and the adapter 10 are adapted to provide an magnetically operated interlock for the nurse call system. As illustrated in FIG. 12, which is a cross-section elevation of the cable end connector 40 along section line AA of FIG. 7, a magnet 100 is embedded in the cable end connector 40 near its toe 65. In one embodiment, the magnet 100 is fully sintered neodymium and is nickel chrome plated.

As shown in FIG. 13, which is a cross-section elevation of the adapter 10 along section line BB of FIG. 8, a magnetically activated reed switch 105 is embedded in the adapter 10 near its toe stop 90 so as to be in close proximity to the magnet 100 when the cable end connector 40 and the primary cable connector 22 are connected. In other embodiments, the magnet 100 will be embedded in other locations in the connector 40 and the reed switch 105 will be embedded in a corresponding location within the adapter 10 to remain in close proximity to the magnet 100 when the cable end connector 40 and the primary cable connector 22 are connected.

Figure 14:
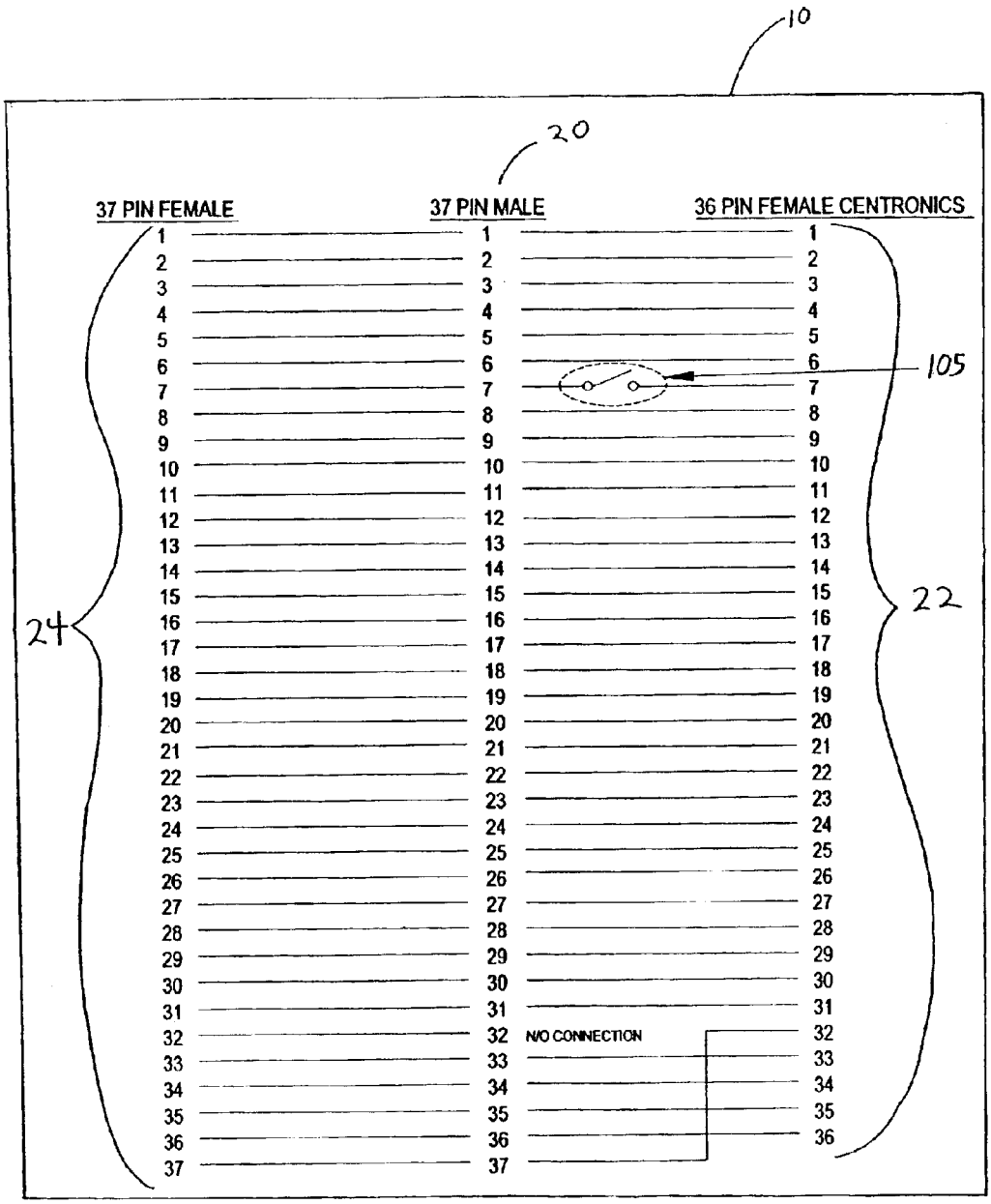
FIG. 14 is a wiring diagram of the adapter in one embodiment of the invention, wherein the adapter has a magnetically activated reed switch.

FIG. 14 shows a wiring diagram of the inside of the adapter 10 illustrated in FIG. 13. The magnetically activated reed switch 105 serves as an interlock to the nurse call system. When the cable end connector 40 is not in close proximity to the reed switch 105 (i.e., the cable end connector 40 is not adequately connected to the primary cable connector 22), an electrical open is sensed by the nurse call system and a "cord out" alarm is initiated. The magnet 100 and reed switch 105 combination makes it much more difficult for someone to defeat this important nurse call function. Also, the magnet 100 and reed switch 105 combination deters a person from installing cable that is inferior, untested, or unapproved for the application.

Although the present invention has been described with reference to certain embodiments, persons skilled in the art will recognize that changes may be made in form and detail without departing from the spirit and scope of the invention.

We claim:

1. An adapter for facilitating the connection of a communications cable connector to a connector of a health care facility wall interface unit, the adapter comprising:

a housing having a first face, a second face and an outside perimeter face, wherein the housing is adapted to be attached to the health care facility wall interface unit and the first face abuts the interface unit when attached;

a first connector, wherein said first connector is located on the first face and adapted to connect to the connector of the health care facility wall interface unit;

a second connector, wherein said second connector is located on the second face and adapted to connect to the cable connector; and a third connector, wherein the third connector is located on the second face and is in electrical communication with the first connector, wherein the first and third connectors both have the same number of electrically conductive pins, wherein the first connector is in electrical communication with the second connector and the first and second connectors have a dissimilar number of electrically conductive pins.

2. The adapter of claim 1, wherein the first connector is a 37-pin D-subminiature male plug.

3. The adapter of claim 1, wherein the second connector is a 36-pin female Centronic-type connector.

4. The adapter of claim 1, wherein the third connector is a 37-pin D-subminiature female plug.

5. The adapter of claim 1, further comprising a mounting piece located on the outside perimeter face.

6. The adapter of claim 1, further comprising a magnetically actuated reed switch.

7. The adapter of claim 1, further comprising a controlled attachment and release mechanism for securing the communication cable to the adapter.

8. The adapter of claim 7, wherein the controlled attachment and release mechanism comprises a friction fit arrangement.

9. The adapter of claim 7, wherein the controlled attachment and release mechanism comprises a bracket and a clamp.

10. The adapter of claim 1, further comprising a communication cable including a connector on a first end and a connector on a second end, wherein the connector on the first end is said cable connector and the connector on the second end is adapted to connect to a hospital bed connector.

11. The adapter of claim 10, wherein the cable connector is a 36-pin male Centronics-type connector and the connector on the second end is a 37-pin connector.

12. The adapter of claim 10, wherein the second connector and the cable connector both have the same number of electrically conductive pins.

13. The adapter of claim 11, wherein the cable connector and the connector on the second end have a dissimilar number of electrically conductive pins.

* * * * *

UNITED STATES PATENT AND TRADEMARK OFFICE

CERTIFICATE OF CORRECTION

PATENT NO. : 6,945,821 B2
DATED : September 20, 2005
INVENTOR(S) : Mark Peter Stoner et al.

It is certified that error appears in the above-identified patent and that said Letters Patent is hereby corrected as shown below:

Column 8,
Line 28, delete "Centronic-type" and insert -- Centronics-type --.
Line 55, delete "11" and insert -- 12 --.

Signed and Sealed this

Fourteenth Day of February, 2006

JON W. DUDAS
*Director of the United States Patent and Trademark Office*